US011203463B2

(12) United States Patent
Septien Rojas

(10) Patent No.: US 11,203,463 B2
(45) **Date of Patent: *Dec. 21, 2021**

(54) CHILD-RESISTANT RECLOSABLE BAGS

(71) Applicant: Jose Manuel Septien Rojas, Scarborough (GB)

(72) Inventor: Jose Manuel Septien Rojas, Scarborough (GB)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/634,619

(22) PCT Filed: Aug. 2, 2018

(86) PCT No.: PCT/US2018/044941

§ 371 (c)(1),
(2) Date: Jan. 28, 2020

(87) PCT Pub. No.: WO2019/028216

PCT Pub. Date: Feb. 7, 2019

(65) Prior Publication Data

US 2020/0231340 A1 Jul. 23, 2020

Related U.S. Application Data

(60) Provisional application No. 62/548,057, filed on Aug. 21, 2017, provisional application No. 62/540,914, filed on Aug. 3, 2017.

(51) Int. Cl.
*B65D 33/25* (2006.01)
*B65D 50/00* (2006.01)

(52) U.S. Cl.
CPC ..... *B65D 33/2541* (2013.01); *B65D 33/2566* (2013.01); *B65D 50/00* (2013.01)

(58) Field of Classification Search
CPC . B65D 33/2541; B65D 33/2566; B65D 50/00
(Continued)

(56) References Cited

U.S. PATENT DOCUMENTS 2,789,609 A 4/1957 Louis
3,282,493 A * 11/1966 Kamins ..... B65D 33/1683 383/203

(Continued)

FOREIGN PATENT DOCUMENTS

CA 2961825 A1 * 3/2016 ..... B65D 33/2566
JP 2004026193 A * 1/2004

(Continued)

OTHER PUBLICATIONS

International Search Report issued in PCT/US2018/044941 dated Nov. 7, 2018.

*Primary Examiner* — Jes F Pascua
(74) *Attorney, Agent, or Firm* — McCarter & English LLP

(57) ABSTRACT

The present disclosure relates to plastic or polymeric container (100) with reclosable zippers or reclosures (10) which make the package child-resistant. In one typical embodiment, this is achieved by a zipper or reclosure (10) including a tab (18) with a tab track (29) that engages with an opposite track (46) on an opposite profile. A user disengages the tab track (29) from the opposite track (46), typically by peeling, in order to open the remainder of the zipper or reclosure (10).

12 Claims, 9 Drawing Sheets

(58) Field of Classification Search
USPC ..... 383/63, 65
See application file for complete search history.

(56) References Cited

U.S. PATENT DOCUMENTS

| | | | | |
|---|---|---|---|---|
| 9,015,910 | B2 * | 4/2015 | Septien Rojas | A44B 19/16 24/399 |
| 10,766,669 | B2 * | 9/2020 | Septien Rojas | B65D 33/2541 |
| 2006/0210202 | A1 * | 9/2006 | Plourde | B65B 51/303 383/63 |
| 2016/0101904 | A1 | 4/2016 | Takigawa | |
| 2016/0122087 | A1 | 5/2016 | Takigawa | |
| 2017/0152085 | A1 | 6/2017 | Septien Rojas et al. | |
| 2020/0198843 | A1 * | 6/2020 | Hansen | B65D 33/2508 |

FOREIGN PATENT DOCUMENTS

| | | | | |
|---|---|---|---|---|
| JP | 2018083649 | A * | 5/2018 | |
| WO | WO-2005092725 | A1 * | 10/2005 | B65D 33/2541 |
| WO | WO-2020006354 | A1 * | 1/2020 | B65D 33/2566 |

* cited by examiner

CHILD-RESISTANT RECLOSABLE BAGS

This application is a National Phase application of PCT/US2018/044941, filed Aug. 2, 2018 which claims priority of U.S. Provisional Application Ser. No. 62/548,057, filed on Aug. 21, 2017 and U.S. Provisional Application Ser. No. 62/540,914, filed on Aug. 3, 2017, the contents of the disclosure of both of which are incorporated by reference herein for all purposes.

BACKGROUND OF THE DISCLOSURE

Field of the Disclosure

The present disclosure relates to various embodiments of child-resistant reclosable packages or bags, particularly wherein a profile of the reclosure includes tabs which have locking elements for engagement with the opposing profile and which must be separated by peeling the tabs away from the opposing profile.

Description of the Prior Art

The prior art includes various child-resistant packages. Typically, these packages are designed to hold medicinal capsules, detergent capsules, or similar items which might be attractive, but harmful, to a child. The prior art has many examples of plastic lids, in order to be removed from the glass or plastic container, which must be squeezed or pushed in various ways which would not be apparent to a child or would be beyond the strength capabilities of the child. However, such containers are complicated to manufacture and add a considerable expense to the consumer product. Additionally, such containers may be heavy and bulky which adds to the costs of transportation. Furthermore, this weight and bulk adds to the recycling burden of these products.

The prior art includes U.S. Published Application No. 2017/0152085, published Jun. 1, 2017, to Rojas, entitled "Child-Resistant Reclosable Packages."

OBJECTS AND SUMMARY OF THE DISCLOSURE

It is therefore an object of the present disclosure to provide child-resistant containers which maintain a high level of child resistance, while achieving reduced weight and costs with respect to manufacture, transportation and recycling.

These and other objects are obtained by a plastic or polymeric container with reclosable zippers which make the package child-resistant. In one typical embodiment, this is achieved by a zipper including a tab with a tab track that engages with an opposite track on an opposite flange. A user disengages the tab track from the opposite track in order to open the remainder of the zipper. An additional embodiment includes a hinged engagement immediately below the level of the tabs.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
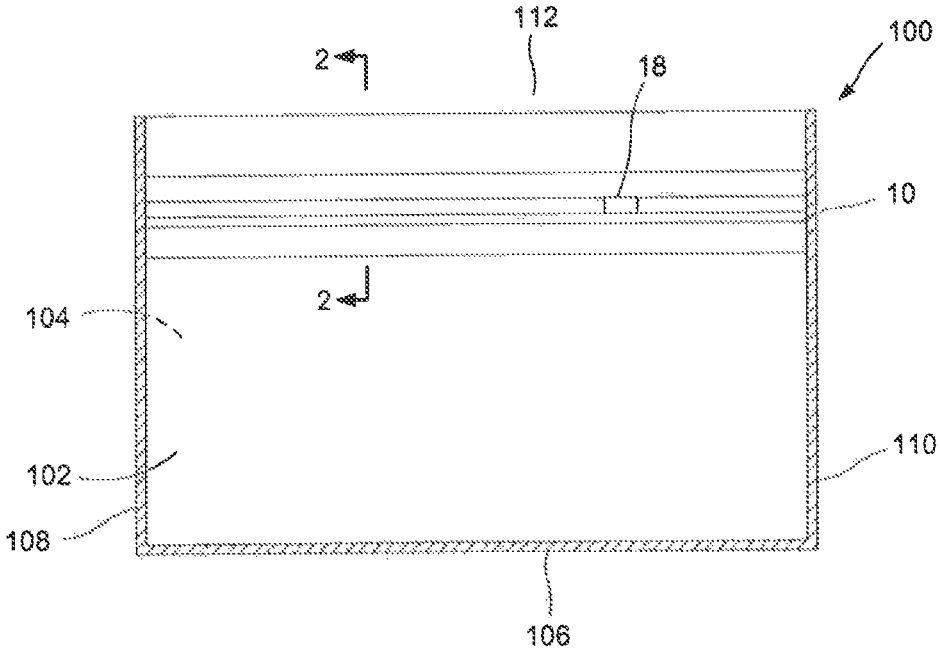
FIG. 1 is a plan view of a typical reclosable package with a reclosure which is an embodiment of the present disclosure.

Referring now to the drawings in detail wherein like numerals refer to like elements throughout the several views, on sees that FIG. 1 discloses a typical reclosable package 100 with an embodiment of the closure, reclosure or zipper 10 of the present disclosure.

While reclosure 10 can be utilized with a wide range of packages, one sees that the typical package 100 of FIG. 1 is made from first and second co-extensive polymeric sheets of material 102, 104, which are sealed to each other at bottom seal 106 and first and second side seals 108, 110, thereby forming mouth 112 which is made reclosable by reclosure 10 which extends transversely across the top of the package 100, downwardly adjacent from the upper edge of first and second sheets of material 102, 104. The reclosure 10 includes first profile 12, which is sealed or otherwise attached to the interior wall of first sheet 102, and second profile 14, which is sealed or otherwise attached to the interior wall of second sheet 104. As will be described in detail, first profile 12 includes tab 18.

Figure 2:
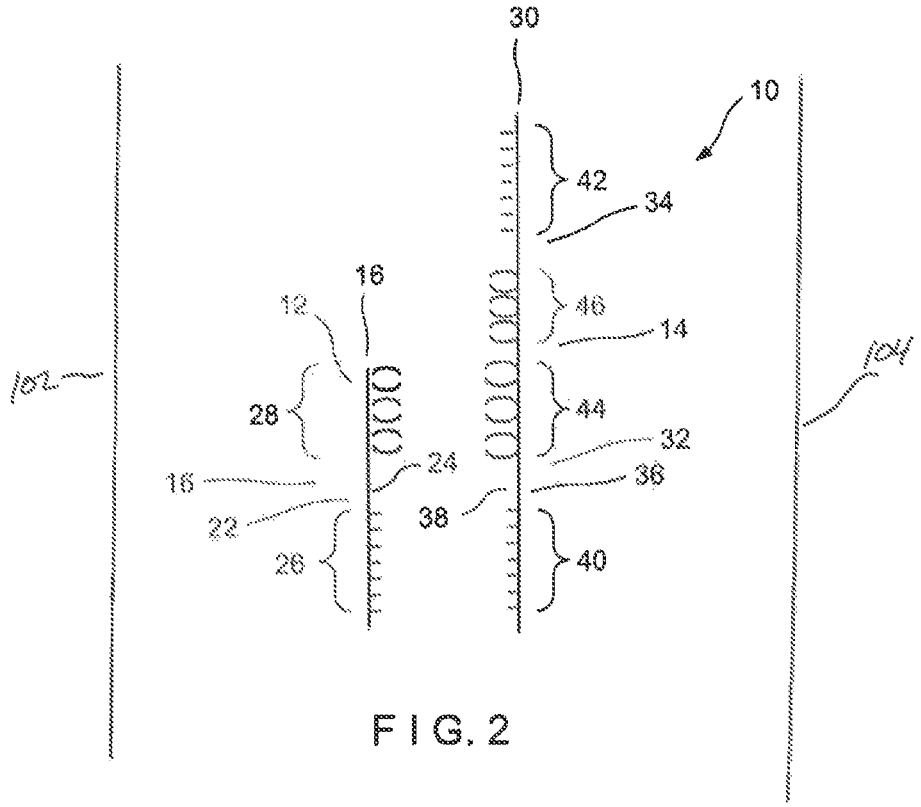
FIG. 2 is an exploded cross-sectional view along plane 2-2 of FIG. 1.
Figure 3:
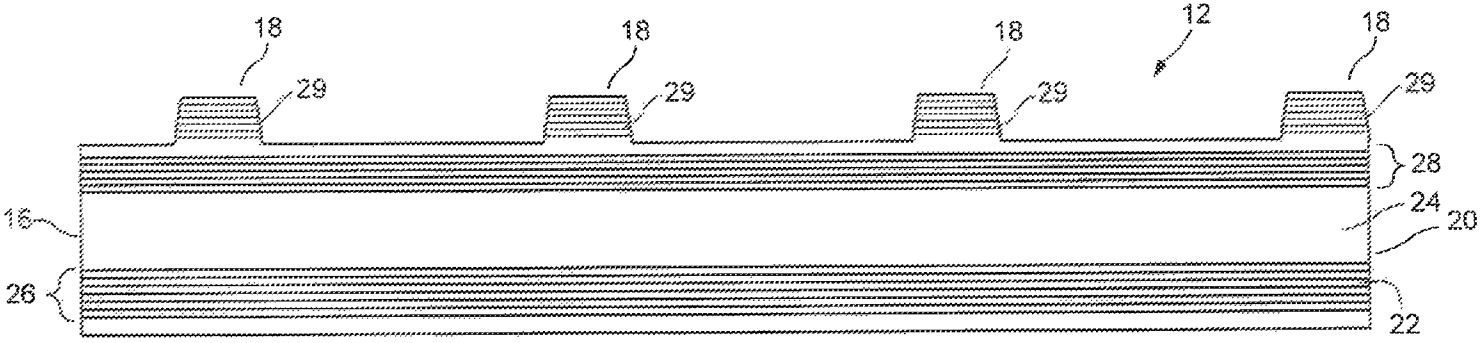
FIG. 3 is a plan view of a first profile of an embodiment of the reclosure of the present disclosure.
Figure 4:
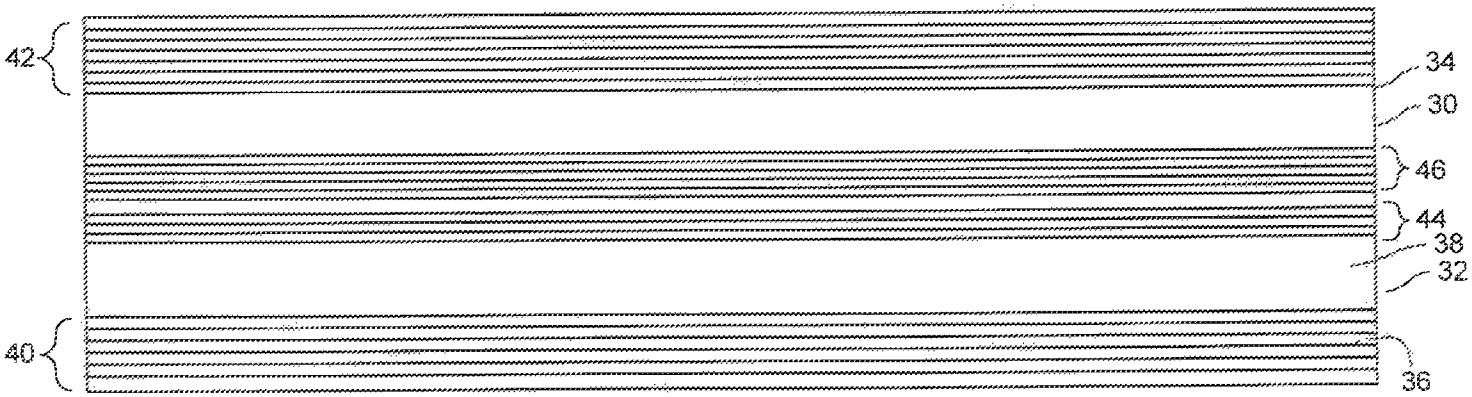
FIG. 4 is a plan view of a second profile of an embodiment of the reclosure of the present disclosure.
Figure 5:
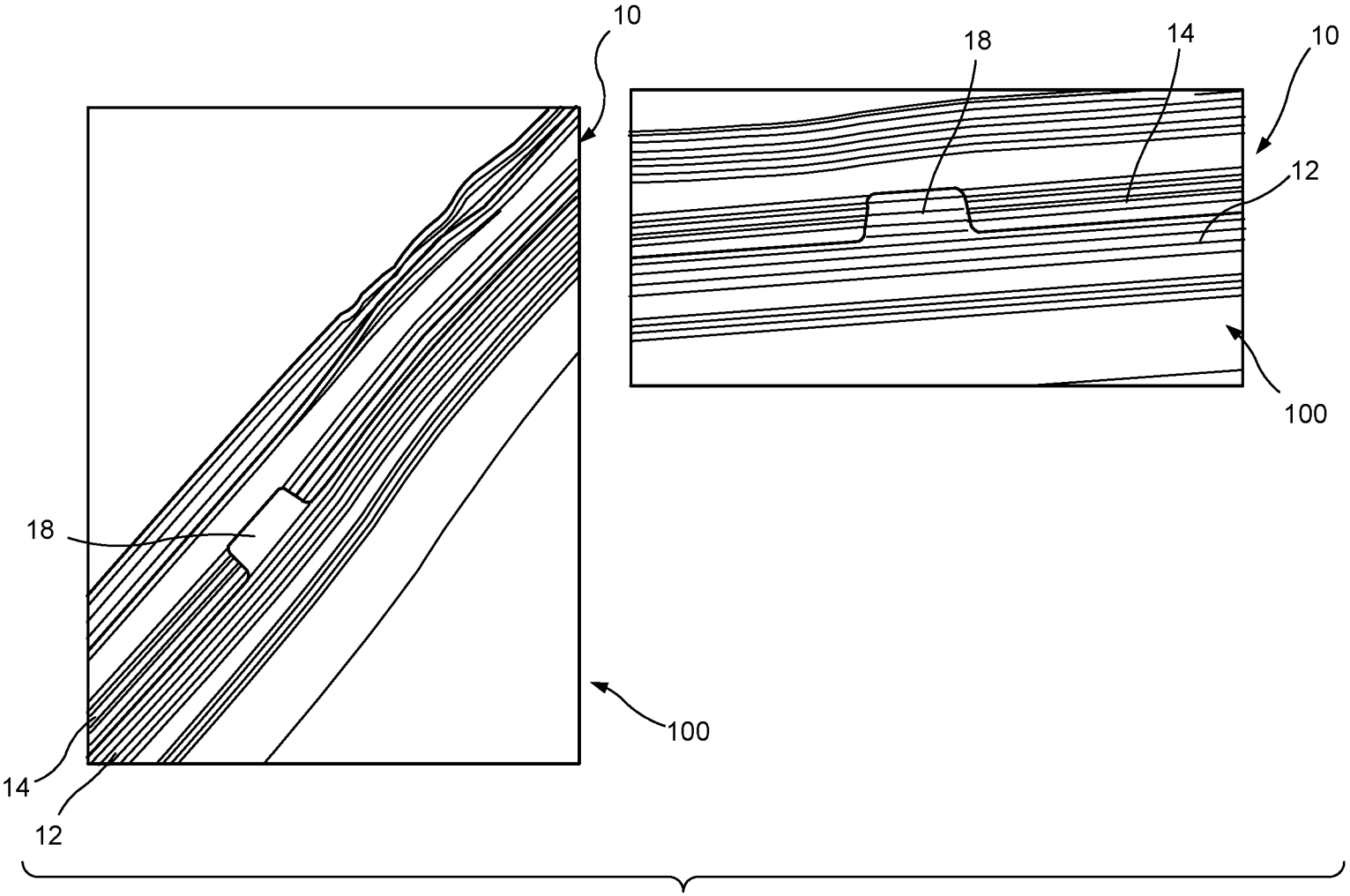
FIG. 5 is a perspective view illustrating a first embodiment of the present disclosure.

FIG. 2 is an exploded cross-sectional view along plane 2-2 of FIG. 1, showing the cross-sectional view of first and second profiles 12, 14, along with the first and second sheets of material 102, 104. FIGS. 3 and 4 illustrate the interior surfaces (i.e., the surfaces which face the opposing profile) of a length of the material for the first and second profiles 12, 14, respectively.

As shown in FIG. 3, a length of the material for the first profile 12 includes a generally rectangular strip-like portion of web 16, with at least one tab 18 extending upwardly from an upper surface thereof. Tabs 18 may be spaced apart such that a single tab 18 is included within the width of a package 100. The plurality of tabs 18 illustrated in FIG. 3 may indicate either that multiple tabs 18 may occur within a package 10, or that the length of material is cut so that a single tab 18 is placed within a single package 10, as illustrated in FIG. 1. The lower portion of first profile 12 is a sealing flange 20 that includes an outwardly facing smooth side 22 for sealing to the first sheet of material 102 and further includes an inwardly facing side 24 with several longitudinally extending anti-sealing protrusions 26. These anti-sealing protrusions 26 extend toward the second profile 14 and are intended to prevent or reduce any sealing between the first and second profiles 12, 14 during the sealing process between the first profile 12 and the first sheet of material 102 and between the second profile 14 and the second sheet of material 104.

In one embodiment, a single tab 18 is 5 mm tall and 10 mm wide. In another embodiment, two tabs 18 are present on the same side of the reclosable package 100 with similar dimensions. In yet another embodiment, a single tab is present that is taller and wider than 5×10 mm. The tabs 18 may be created on the first profile 12, for example, but not limited to, mechanically cutting the tab (e.g., from a flange/track/side), laser cutting the tab, attaching a separate tab material to a separate interlocking element material, extruding the tab, or other methods of manufacture known in the art.

In some embodiments, a one-time openable structure is located above the opening of the reclosable bag and the zipper closure. The one-time openable structure is made from, for example, but not limited to, an extension of the front and back walls of the reclosable bag and sealed together, or folded, at the top above the opening and zipper closure.

The first and second profiles 12, 14, including the zipper closure (interlocking elements, tabs with tab tracks, and opposite tracks)—is manufactured from plastics or polymers known in the art. For example, the first and second profiles 12, 14 may be manufactured from, but not limited to, polyethylene or polypropylene. The reclosable bag is made from, for example, but not limited to, PolyEthylene Terephthalate (PET) laminate film. PET laminate film offers high seal integrity and good moisture barrier characteristics. The first and second profiles may be applied to the reclosable package 100 during, for example, but not limited to, a vertical form fill and seal (VFFS) packing line.

First lower interlocking tracks 28 are parallel to each other and positioned at an upper longitudinal area of strip-like portion of rectangular web 16, below tabs 18. First lower interlocking tracks 28 are arranged and configured to be releasably interlockable with complementary second lower interlocking tracks 44 (see FIG. 4) of second profile 14. Additionally, tabs 18 include first upper interlocking tracks 29 which are parallel to each other and arranged and configured to be releasably interlockable with complementary second upper interlocking tracks 46 (see FIG. 4).

As shown in FIG. 4, a length of material for the second profile 14 includes a generally rectangular strip-like portion of web 30, of a width (i.e., the vertical dimension in FIG. 4) greater than that of web 16 of the first profile 14. The lower portion of second profile 14 is a lower sealing flange 32 while the upper portion of second profile 14 is an upper sealing flange 34. Lower and upper sealing flanges 32, 34 includes an outwardly facing smooth side 36 for sealing to the second sheet of material 104 and further includes an inwardly facing side 38 with several longitudinally extending anti-sealing protrusions 40, 42, respectively. These anti-sealing protrusions 40, 42 extend toward the first profile 12 and are intended to prevent or reduce any sealing between the first and second profiles 12, 14, or between the second profile 14 and the first sheet of material 102 during the sealing process between the first profile 12 and the first sheet of material 102 and between the second profile 14 and the second sheet of material 104.

The length of material for the second profile 14 includes second lower interlocking tracks 44 which are parallel to each other and arranged and configured to be releasably interlockable with complementary first lower interlocking tracks 28 of first profile 12. The length of material for the second flange 14 further includes second upper interlocking tracks 46 which are parallel to each other and arranged and configured to be releasably interlockable with complementary first upper interlocking tracks 29 on tabs 18 of first profile 12. Second lower and upper interlocking tracks 44, 46 are formed parallel and adjacent to each other, between lower and upper sealing flanges 32, 34.

In the interlocked configuration, first and second upper interlocking tracks 29, 46 are interlocked with each other and first and second lower interlocking tracks 28, 44 are interlocked with each other.

In summary, this configuration contributes to the child-resistant characteristics of reclosure 10, and therefore, package 100. In the interlocked configuration, there is no way for a user to grip first profile 12 effectively, in order to separate the first and second lower interlocking tracks 28, 44, other than by grasping or gripping tab 18. However, the user is unable to manually grip or grasp tab 18 while first and second upper interlocking tracks 29, 46 are interlocked with each other. In order to get tab 18 into a grippable position, the user must first peel the tab 18 away from second profile 14 so that first and second upper interlocking tracks 29, 46 are not interlocked and then grip the tab 18 and pull the first profile 12 away from the second profile 14.

FIGS. 5-8 illustrate a first embodiment of the present disclosure. A reclosable package 100 includes a tab 18 with a tab track 29—also known as, for example, but not limited to, first upper interlocking tracks, engaging elements, and/or zipper profile—on a first side of an opening of the reclosable package 100. The tab 18 with the tab track (first upper interlocking tracks) 29 is created on a first profile 12 above (i.e., consumer side, outside, etc.) first lower interlocking tracks 28. The first upper interlocking tracks 29 engage a second upper interlocking tracks 46 on the second profile 14. Therefore, the tab 29 is able to be locked into the opposite side, adding a difficulty for a user of the reclosable package 100 in grabbing the tab to open reclosable package 100.

Figure 6:
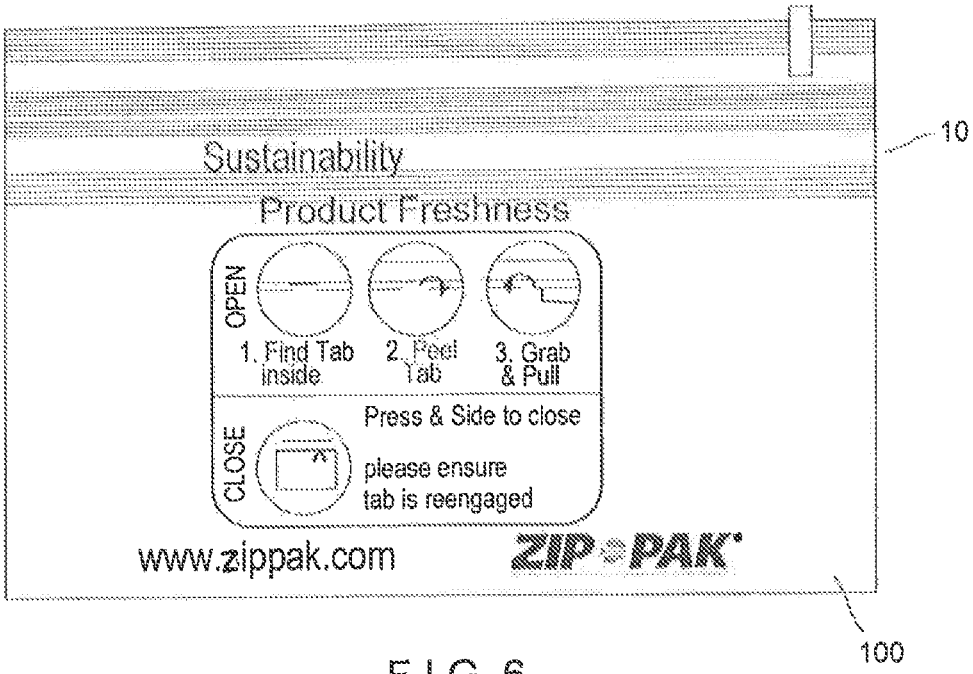
FIG. 6 is a front view illustrating the first embodiment of the present disclosure.

FIG. 6 illustrates a front view of the reclosable package 100. Printed on an outer surface of the reclosable package 100 are instructions on how to open the reclosable package 100. As described above, the user locates the tab 18 inside of the opening. Then the user peels the tab 18—disengaging the first upper interlocking tracks 29 from the second upper interlocking tracks 46. Once disengaged, the user can more completely/firmly grab the tab 18 and pull apart the first and second profiles 12, 14 and access contents inside the reclosable package 100.

Figure 7A:
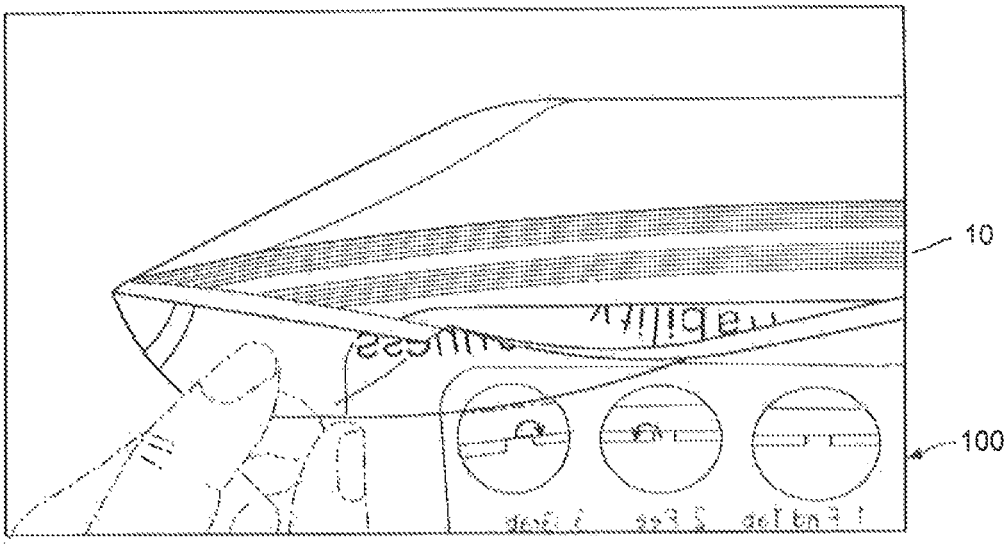
FIGS. 7A-7B are detailed views illustrating the first embodiment of the present disclosure in a closed configuration.
Figure 7B:
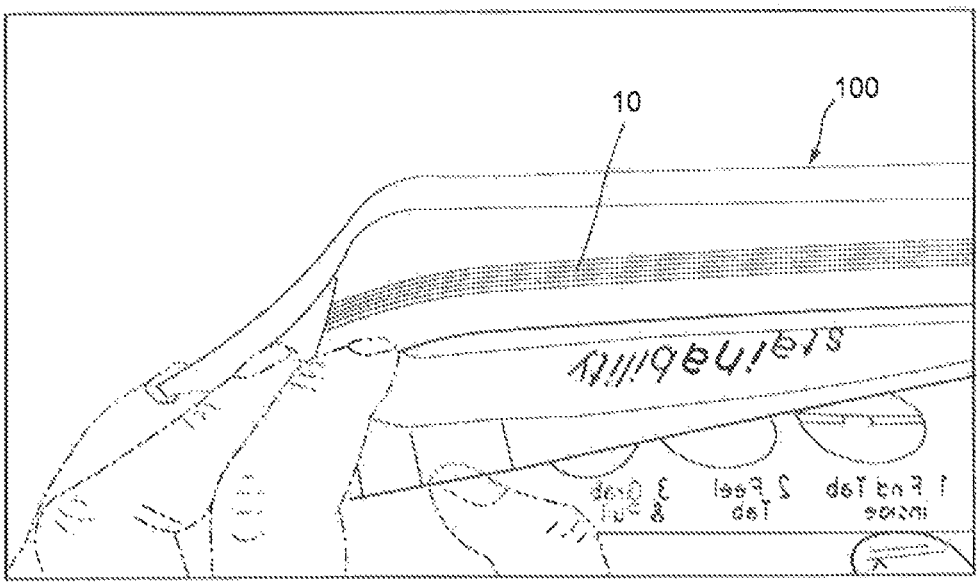

FIG. 7A illustrates a close-up view of the tab in an engaged configuration with the reclosable package 100 in a closed configuration. FIG. 7B illustrates a close-up view of the tab 18 in a disengaged configuration with the reclosable package 100 still in the closed configuration. The user has peeled the tab 18 by disengaging the first and second upper interlocking tracks 29, 46 from each other. The first and second lower interlocking tracks 22, 44 remain in the closed configuration.

Figure 8:
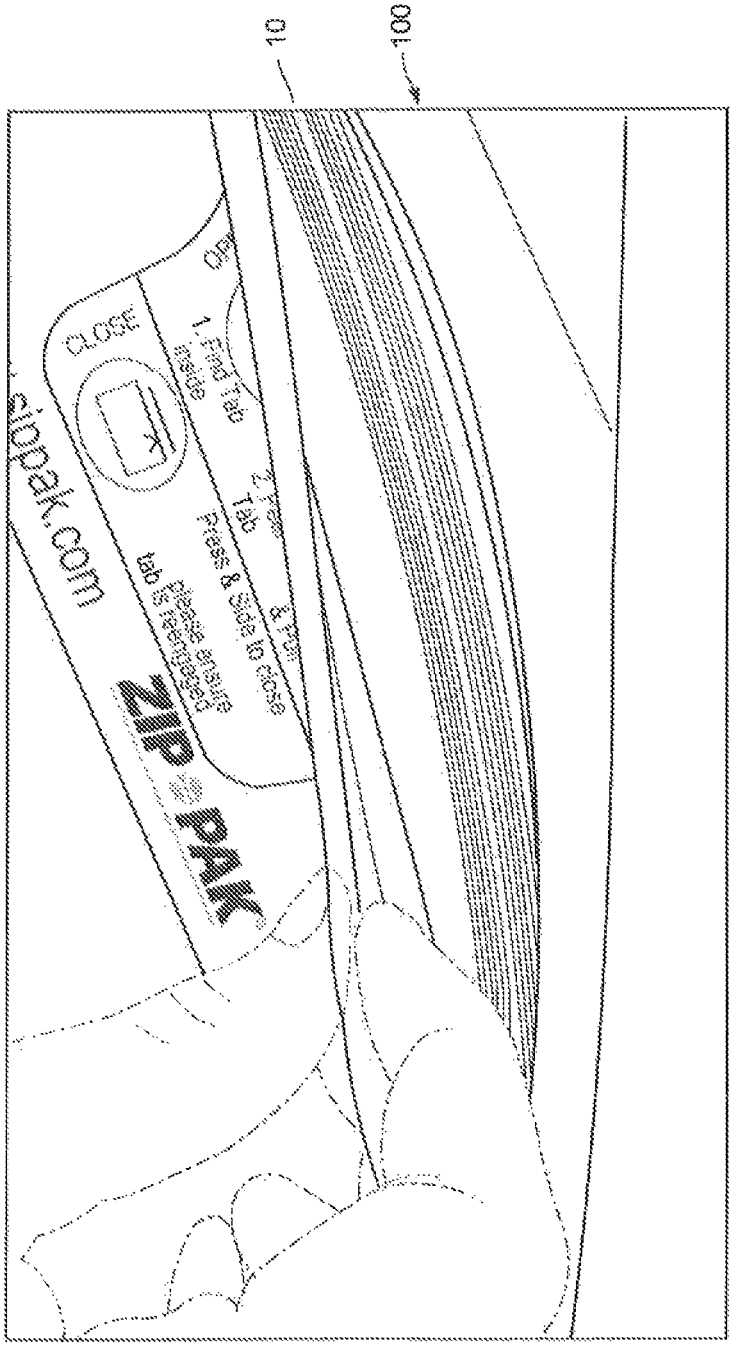
FIG. 8 is a top view illustrating the first embodiment of the present disclosure in an open configuration.
Figure 9:
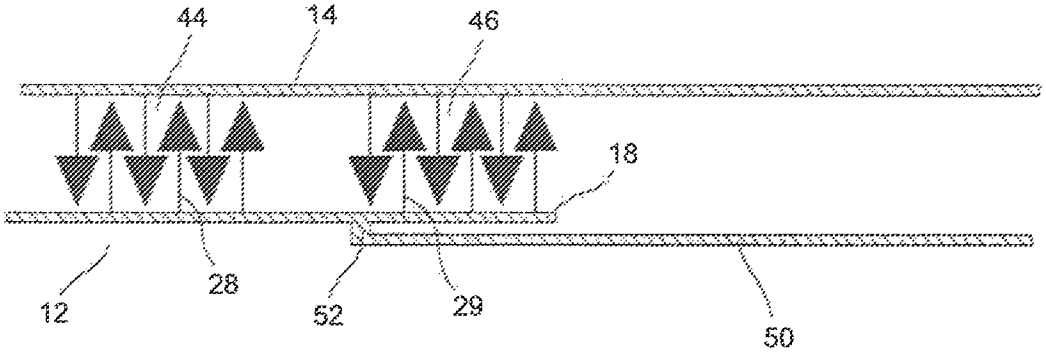
FIG. 9 is cross-section view illustrating another embodiment of the present disclosure.

FIG. 8 illustrates a close-up view of the reclosable package 100 in an open configuration. The user has pulled on the disengaged tab 18 and thus exerted a force to disengage the first profile 12 from the second profile 14. The user can now access contents of the reclosable package 100. To close the reclosable package 100 and re-engage the tab 18 to the opposite side, the user presses firmly against both the first and second upper interlocking elements 29, 46 and the first and second lower interlocking elements 22, 44. FIG. 9 includes additional views illustrating the first embodiment of the present disclosure. A single tab 18 with tab track 29 is located above the interlocking elements.

FIG. 9 illustrates a cross-sectional view of another embodiment of the present disclosure. In this embodiment, the reclosure 10 includes a hinged locking element 50. The cross-section is taken perpendicular to the length of the first and second profiles 12, 14 and the planar surface of the reclosable package. The first profile 12 is shown below the second profile 14. The first profile 12 includes a hinge 52 immediately below (or, in the orientation of FIG. 9, to the left of) the tab 18, connecting hinged locking element 50 to first profile 12. The tab 18 extends from the hinge 52, enabling the hinged locking element 50 to be grasped separately from the remainder of the zipper profiles 102, 104. As described above, the first upper interlocking tracks 29 (on tab 18) are operable to engage and disengage from the second upper interlocking tracks 46. The first embodiment of FIGS. 1-8 does not use a hinge but may be modified to include the hinge structure (elements 50, 52) of FIG. 9.

In one embodiment, the tab track and the opposite track include a plurality of engaging tracks, which may be continuous or intermittent. In some embodiments, the engaging tracks are self-mating or hermaphroditic. In other embodiments, only one engaging track is found on each side, such as a male extrusion and a female extrusion.

The first and second interlocking elements are located below (i.e., on the inside of the reclosable bag) the tab with tab track and the opposite track. Similar to the tab and opposite tracks, the interlocking elements may include a plurality of engaging tracks, continuous or intermittent, may be self-mating, or may include only one engaging track on each side, such as a male extrusion and a female extrusion.

Figure 10:
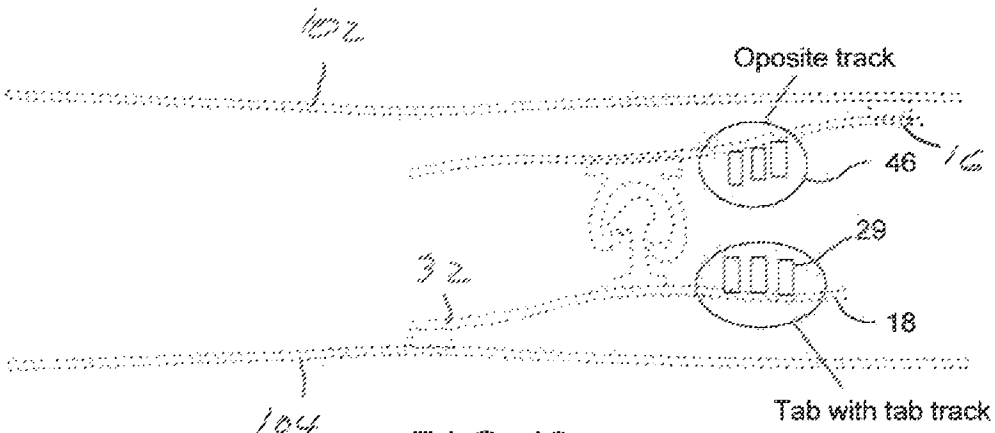
FIG. 10 is a cross-section view illustrating yet another embodiment of the present disclosure.
Figure 11A:
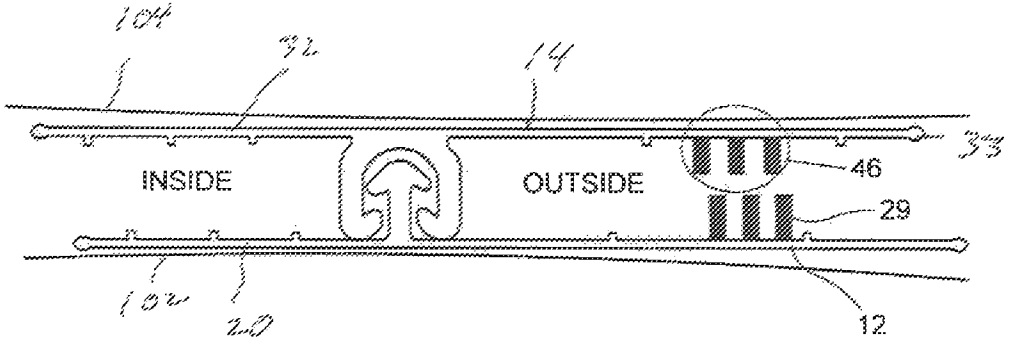
FIGS. 11A-B are cross-section views illustrating yet another embodiment of the present disclosure.
Figure 11B:
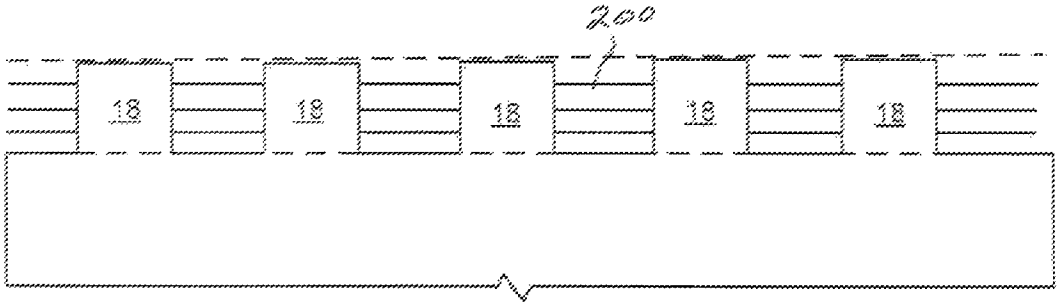

FIGS. 10, 11A and 11B are similar to those of U.S. Published Application US2017/0152085 (U.S. patent application Ser. No. 15/427,333). FIGS. 10, 11A and 11B illustrate alternative embodiments of the zipper profile of the present disclosure. Zipper, reclosure or closure 10 includes first and second profiles 12, 14. First profile 12 includes a first exterior flange 16 and a first interior flange 20. Likewise, second profile 14 includes second exterior flange 34 and a second interior flange 32. The first exterior flange 16 and the second interior flange 32 are sealed to the respective first and second side 102, 104 and the first interior flange 20 and the second exterior flange 34 are free of connection to the sidewalls 102, 104.

In the configuration illustrated in FIG. 10, if a child grabbed the first and second sidewalls 102, 104 and tried to pull them apart in the conventional manner, the second sidewall 104 would transmit the opening forces to the interior side of the female and male interlocking elements thereby encountering the high interior opening force and making the zipper 10 very difficult, if not impossible, to open with regular manual forces. However, if one grabbed the second exterior flange 16 (specifically the tab with tab track) and the first sidewall 102 (specifically the opposite track), and pulled them apart, the lower exterior opening force will be encountered and the zipper will easily open. The tab with tab track and opposite track are circled. FIG. 8 shows the disengaged configuration of the tab track and opposite track; the reclosable bag is still in the closed configuration. Pulling on the disengaged tab will disengage interlocking elements and open the reclosable bag.

FIG. 11A illustrates a variation wherein sealing jaws 112, 114 seal the first exterior flange 16 to the first sidewall 102 and the second interior flange 34 to the second sidewall 104, but the first interior flange 18 and the second exterior flange 32 (with an upper edge 33) are free of sealing. The tab with tab track and opposite track are circled and operable as described above.

FIG. 11B illustrates a plurality of upwardly extending tabs 18 (i.e., the tab with tab track). The tabs 18 are illustrated as rectangular but other shapes may be used. The upper side of the upwardly extending tabs 18 are typically of the same height (i.e., the same relationship with the second sidewall 104) as the horizontal upper edge of FIG. 11A. The tabs 18 with tab tracks 29 engage and disengage the opposite tabs (analogous to second upper interlocking tracks 46). As it is more difficult for the user to grip the upwardly extending tabs 18 rather than a non-tabbed or un-cut flange, the resulting configuration is intended to become more child-resistant The tabs 18 include the tab track (or first upper interlocking tracks) 29 that engage the second profile 14 as described above with respect to FIGS. 1-8. The tabs 18 may be placed opposite to printed icons on the bag walls which say "Open Here" or similar cue which will be helpful to an adult to operate the reclosure 10, but will not be helpful to a young child who is unable to read or follow written instructions. The flange 200 of FIG. 11B is a portion of zipper profile between the tabs 18 and the interlocking elements. In some embodiments, there is no intermediate flange and the tab 18 is located immediately above the interlocking elements.

In addition to using engaging tracks on the tab and opposite side, a resealable adhesive may be used. The resealable adhesive may be applied to one or both of the tab and the opposite side. As with the tab with tracks and opposite tracks, a tab with resealable adhesive can engage and disengage from the opposite side with opposite resealable adhesive. A user peels the tab and then can pull apart the closure of the reclosable bag. The resealable adhesive is, for example, but not limited to, a water-based adhesive, a hot melt adhesive, a resin adhesive, an acrylic adhesive, and a pressure sensitive adhesive.

In a first variation with adhesive, one or both of the tab and the opposite side have resealable adhesive and a reclosable profile below has interlocking elements/tracks (male, female, or self-mating). In a second variation with adhesive, both the tab and the opposite side have engaging/interlocking tracks and the reclosable profile below has resealable adhesive (e.g., on one or both sides of the opening of the reclosable bag). In a third variation with adhesive, the tab, the opposite side, and the reclosable profile all have at least some resealable adhesive. In reclosable bags for food items, the resealable adhesive should meet food contact substance regulations.

Figure 12:
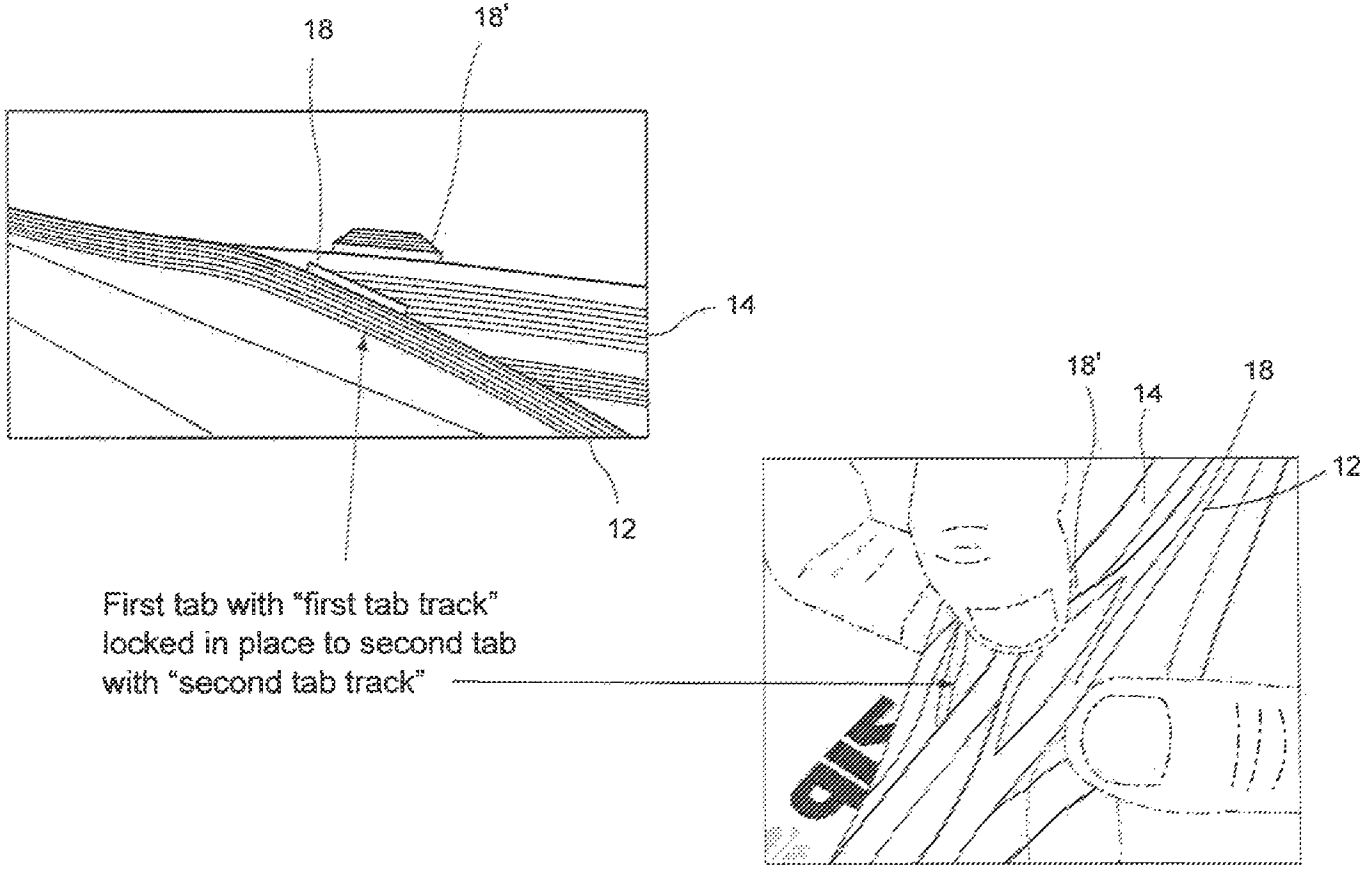
FIG. 12 is a perspective view illustrating a second embodiment of the present disclosure.

FIG. 12 is a perspective view illustrating a second embodiment of the present disclosure. Rather than a full opposite track along substantially all of the opposite side (i.e., the first embodiment), the second embodiment includes a first side tab 18 with a first tab track 29 and a second side tab 18' with a second tab track 29'. The first side tab 18 is aligned with the second side tab 18' so that the first tab track 29 can engage and interlock with the second tab track 29'. To open the reclosable package 100, the user disengages the first side tab 29 from the second side tab 29'.

In one embodiment, the first side tab 29 and the second side tab 29' are both free from connections to the first and second sidewalls of the reclosable bag. The first/second side tabs 29, 29' extend above the interlocking elements of the first and second zipper profiles 12, 14, and the zipper profile is connected/sealed to the sidewalls 102, 104 of the reclosable package 102, 104 at/near the interlocking elements.

Thus, the several aforementioned objects and advantages are most effectively attained. Although preferred embodiments of the invention have been disclosed and described in detail herein, it should be understood that this invention is in no sense limited thereby.

What is claimed is:

1. A reclosure (10) for a reclosable package (100), including:

a first profile (12) and a second profile (14);

the first profile (12) including a first web portion (16) with a plurality of tabs (18) extending from an upper edge thereof and spaced apart and separated from each other along the upper edge with a non-tabbed area between successive tabs (18), a first lower interlocking element (28) on the first web portion (16) and a first upper interlocking element (29) on the plurality of tabs (18);

the second profile (14) including a second web portion (30) with a second lower interlocking element (44) and a second upper interlocking element (46);

wherein the first lower interlocking element (28) and the second lower interlocking element (44) interlock with each other in an interlocked configuration;

wherein the first upper interlocking element (29) and the second upper interlocking element (46) interlock with each other in the interlocked configuration;

wherein the first lower interlocking element (28) comprises a first plurality of tracks spanning a length of the first profile (12) and the second lower interlocking element (44) comprises a second plurality of tracks spanning a length of the second profile (14) and wherein the first upper interlocking element (29) comprises a third plurality of tracks spanning a length of the tabs (18) of the plurality of tabs (18) and the second upper interlocking element (46) comprises a fourth plurality of tracks spanning a length of the second profile (14).

2. The reclosure (10) of claim 1 wherein the tracks of the first plurality of tracks (28) are parallel to each other; the tracks of the second plurality of tracks (44) are parallel to each other; the tracks of the third plurality of tracks (29) are parallel to each other; and the tracks of the fourth plurality of tracks (46) are parallel to each other.

3. The reclosure (10) of claim 2 wherein the first profile (12) includes a first sealing flange (20) on a lower area thereof.

4. The reclosure (10) of claim 3 wherein the first sealing flange (20) includes first anti-sealing protrusions (26).

5. The reclosure (10) of claim 4 wherein the second profile (14) includes a second sealing flange (34) on an upper area thereof and a third sealing flange (32) on a lower area thereof.

6. The reclosure (10) of claim 5 wherein the second sealing flange (34) includes second anti-sealing protrusions (42) and the third sealing flange (32) includes third anti-sealing protrusions (40).

7. The reclosure (10) of claim 6 wherein the first upper interlocking element (29), the first lower interlocking element (28) and the first anti-sealing protrusions (26) are formed on an inner side of the first profile (12) and a first smooth surface is formed on an outer side of the first profile (12).

8. The reclosure (10) of claim 7 wherein the second upper interlocking element (46), the second lower interlocking element (44), and the second and third anti-sealing protrusions (42, 44) are formed on an inner side of the second profile (14) and a second smooth surface is formed on an outer side of the second profile (14).

9. The reclosure (10) of claim 2 wherein the second (44) and fourth plurality of tracks (46) are formed adjacent to each other and parallel to each other.

10. The reclosure (10) of claim 1 wherein, in the interlocked configuration, the plurality of tabs (18) are engaged with the second profile (14).

11. The reclosure (10) of claim 1 wherein the first profile (12) and the second profile (14) are formed of polymeric material.

12. A reclosable package (100) including:

a first wall (102);

a second wall (104) co-extensive with the first wall (102) and attached thereto along edges thereof;

a reclosure (10) including:

a first profile (12) attached to the first wall (102);

a second profile (14) attached to the second wall (104);

the first profile (12) including a first web portion (16) with a plurality of tabs (18) extending from an upper edge thereof and spaced apart and separated from each other along the upper edge with a non-tabbed area between successive tabs (18), a first lower interlocking element (28) on the first web portion (16) and a first upper interlocking element (29) on the plurality of tabs (18);

the second profile (14) including a second web portion (30) with a second lower interlocking element (44) and a second upper interlocking element (46);

wherein the first lower interlocking element (28) and the second lower interlocking element (44) interlock with each other in an interlocked configuration;

wherein the first upper interlocking element (29) and the second upper interlocking element (46) interlock with each other in the interlocked configuration;

wherein the first lower interlocking element (28) comprises a first plurality of tracks spanning a length of the first profile (12) and the second lower interlocking element (44) comprises a second plurality of tracks spanning a length of the second profile (14); and wherein the first upper interlocking element (29) comprises a third plurality of tracks spanning a length of the tabs (18) of the plurality of tabs (18) and the second upper interlocking element (46) comprises a fourth plurality of tracks spanning a length of the second profile (14).

* * * * *